US005267645A

United States Patent [19]

Tokunaga et al.

[11] Patent Number: 5,267,645

[45] Date of Patent: Dec. 7, 1993

[54] STOWABLE CONTAINER

[75] Inventors: Kenshin Tokunaga, Hirao; Atsushi Ueda, Hikari; Yasunori Kunishige, Tabuse, all of Japan

[73] Assignee: Takeda Chemical Industries, Ltd., Osaka, Japan

[21] Appl. No.: 37,379

[22] Filed: Mar. 26, 1993

[30] Foreign Application Priority Data

Mar. 27, 1992 [JP] Japan ..... 4-026029[U]

[51] Int. Cl.[5] ..... B65D 75/00

[52] U.S. Cl. ..... 206/188; 206/446; 229/117; 229/120.26; 229/120.27

[58] Field of Search ..... 206/188, 193, 196, 446; 229/120.18, 120.26, 120.27, 120.29, 120.31, 117

[56] References Cited

U.S. PATENT DOCUMENTS

| | | | |
|---|---|---|---|
| 1,072,185 | 9/1913 | Smiley | 229/120.18 |
| 2,389,222 | 11/1945 | Walsh | 229/120.26 |
| 2,820,586 | 1/1958 | Gerald | 229/120.26 |
| 3,184,141 | 5/1965 | Vrana | 229/117 |
| 3,229,849 | 1/1966 | Spillson | 206/188 |
| 3,845,898 | 11/1974 | Hackenberg | 229/120.27 |

*Primary Examiner*—David T. Fidei

*Attorney, Agent, or Firm*—Wenderoth, Lind & Ponack

[57] ABSTRACT

A stowable container of a generally rectangular boxlike configuration which is easy to selectively erect and fold includes front and rear side walls, a pair of end walls, a top flap, a bottom wall and a pair of longitudinally partition walls while defining a longitudinally extending pocket therebetween. Rows of a plurality of bottle chambers are defined by a group of transverse walls extending between one of the longitudinal partition wall and the front side wall and between the other of the longitudinal partition wall and the rear side wall for accommodating respective rows of bottles therein. The bottom wall includes a pair of bottle wall segments continued from the front and rear side walls, respectively. When the container is folded, the bottom wall segments buckle inwardly of the box so as to protrude into the longitudinal pocket to allow the container to be flattened. The longitudinal pocket may be used for accommodating printed matter such as a printed description associated with the contents of each bottle.

5 Claims, 4 Drawing Sheets

STOWABLE CONTAINER

BACKGROUND OF THE INVENTION

1. Field of the Invention

The present invention generally relates to a stowable container made of a flexible sheet such as cardboard, corrugated paper or plastic sheet and, more particularly, to the stowable carton of a type which, when in a stowed condition, represents a generally flat multi-ply structure, but which, when in an erected condition, represents a generally rectangular box-like configuration ready to accommodate therein an object to be stored such as, for example, a plurality of medical bottles or vials.

2. Description of the Prior Art

The Japanese Laid-open Utility Model Publication No. 2-90223, published Jul. 17, 1992, discloses a stowable container made of a flexible sheet of the type referred to above. The stowable container disclosed therein comprises, when in an erected condition, a generally rectangular box of one-piece construction including front and rear side walls that extend parallel to and in face-to-face relation to each other, left-hand and right-hand end walls that extend parallel to and in face-to-face relation to each other, but perpendicular to the front and rear side walls, a top wall hingedly connected to a top edge of the rear side wall and having a tuck flap hinged to a free side edge of the top wall, left-hand and right-hand top dust flaps hingedly connected to respective top edges of the left-hand and right-hand end walls, and a bottom wall. The top wall having the tuck flap is adapted to selectively close and open a rectangular top opening of the box while the bottom wall closes a bottom opening of the box. The left-hand and right-hand top dust flaps are adapted to be folded inwardly of the top wall to partially overlay the top opening of the box when the top opening of the box is closed.

The bottom wall consists of front and rear bottom wall segments hingedly connected with respective bottom edges of the front and rear side walls, and generally triangular left-hand and right-hand bottom flap segments hingedly connected with respective bottom edges of the left-hand and right-hand end walls.

The rectangular box also includes front and rear longitudinal partition walls extend parallel to each other and also to the front and rear side walls, but brought into contact with each other as the stowable carton is erected from a patterned blank of flexible sheet material, and a plurality of transverse partition walls that are spaced an equal distance from each other while extending between each longitudinal partition wall and the adjacent front or rear side wall to define a respective row of bottle chambers for accommodating medical vials.

The stowable carton disclosed in the above mentioned publication has the following problems since, when the erected stowable carton is to be stowed, the front and rear longitudinal partition walls and the associated transverse partition walls integral therewith are displayed sideways relative to each other while the bottom wall segments are buckled inwardly of the box.

a) If each of the bottom wall segments protrude a relatively great distance from a bottom edge of the associated front or rear side wall, the bottom wall segments cannot be satisfactorily accommodated within the box when the carton is stowed, having been interfered by the presence of the front and rear longitudinal partition walls within the box. Therefore, the distance of protrusion of each bottom wall segment from the bottom edge of the associated side wall must be small, the consequence of which is that, when the stowable carton is in the erected condition, the bottom wall segments overlap a small quantity with each other, thereby failing to provide a firm and robust bottom wall.

b) If in order to eliminate the above problem (a) design is made so that the front and rear longitudinal partition walls can be positioned at a relatively high level above the bottom wall when the stowable carton is in the erected condition, a difficulty would be encountered in removing the bottles individually from the box particularly when each bottle has a height lower than the level of the front and rear longitudinal partition walls. This is because the front and rear longitudinal partition walls interfere the access to the bottles.

c) Since no space is provided between the front and rear longitudinal partition walls when the prior art stowable container is in the erected condition, printed matter D such as, for example, a description or a leaflet setting forth information on efficacy, dosage or any other description associated with the contents of each or all of the bottles has to be placed within the box so as to overlay the bottles. When the printed matter is so placed inside the box while overlaying the bottles, and if the user wishes only to ascertain, for example, the number or type of the bottles contained or remaining within the box, the used has to remove the printed matter the first thing before he or she ascertains the number or type of the bottles. In other words, unless the printed matter overlying the bottles is removed, a quick review and/or removal of the individual bottles within the box is not possible.

SUMMARY OF THE INVENTION

The present invention has been devised with a view to substantially eliminating the above discussed problems and is intended to provide an improved stowable container which can easily be erected and folded selectively and which permits a quick review and/or removal of the individual contents accommodated within the stowable container.

To this end, the present invention provides a stowable container of generally rectangular box-like configuration. This container comprises first and second side walls extending parallel to and in face-to-face relation to each other; first and second end walls that extend parallel to and in face-to-face relation to each other, but perpendicular to the first and second side walls; a top wall member hingedly connected to a top edge of the second side wall and adapted to selectively close and open a rectangular top opening of the container when the container is in an erected condition; a bottom wall adapted to closes a bottom opening of the container and including a pair of bottle wall segments hingedly connected to respective bottom edges of the first and second side walls, and a pair of bottom flap segments connected with respective portions of the bottom wall segments and hingedly connected to respective bottom edges of the first and second end walls; first and second longitudinal partition walls extending parallel to each other and also to the first and second side walls while being spaced a distance from each other to define a longitudinally extending pocket therebetween; and a plurality of transverse partition walls spaced an equal distance from each other while extending between each longitudinal partition wall and the adjacent side wall to define a respective row of chambers for accommodating articles to be contained within the stowable container.

When the stowable container is folded, the bottom wall segments and the bottom flap segments are buckled inwardly of the container and into the longitudinally extending pocket, thereby to allow the stowable container to be substantially flattened in a stowed condition.

Thus, according to the present invention, the use is made of the two longitudinal partition walls to define the longitudinally extending pocket therebetween. This longitudinally extending pocket is utilized not only to accommodate the bottom wall segments including the bottom flap segments when they are buckled inwardly of the container as the latter is folded into the substantially flattened condition, but also to accommodate printed matter in an upright position when the container is in the erected condition with the bottles accommodated therein.

The stowable container in the stowed or flattened condition can readily and easily be erected into the generally box-like configuration merely by applying an external pushing force acting in opposite directions to what correspond to a pair of diagonally opposite corners of the box. As the stowable container is erected, the longitudinal partition walls then brought close together are separated away from each other in a direction perpendicular to any one of the side walls to reshape the longitudinally extending pocket therebetween.

The stowable container of the design according to the present invention brings about the following advantages.

I) Even though each of the bottom wall segments protrude a relatively great distance from a bottom edge of the associated front or rear side wall, the bottom wall segments can be satisfactorily accommodated within the box when the carton is stowed, having protruded into the longitudinally extending pocket. Therefore, the bottom wall segments overlap with each other in a relatively large surface area, thereby rendering the bottom wall as a whole to be firm and robust. Moreover, when the container is stowed, the contained represents a generally flattened shape making it easy and convenient to transport and/or store the containers.

II) When the container in the stowed condition is erected, the longitudinal partition walls are separated from each other accompanied by erection of the transverse side walls so as to extend perpendicular to the longitudinal partition walls, thereby to form the longitudinally extending pocket between the longitudinal partition walls. Simultaneously therewith, the bottom wall segments are outwardly bucked to establish the bottom wall. Consequently, the mere application of the external pushing force in the opposite directions to what correspond to the pair of the diagonally opposite corner of the box results in a flattening of the container.

III) Since, as the stowable container is stowed or flattened, the bottom wall segments are inwardly buckled so as to protrude into the longitudinally extending pocket which is then progressively decreasing in size, each of the bottom wall segments may protrude a relatively great distance from the bottom edge of the associated side wall if so desired according to the height of each bottles to be accommodated within the stowable container. Accordingly, if the patterned blank of flexible sheet material from which the stowable container of the present invention can be assembled is properly designed in consideration of the size and/or the height of the bottles desired to be accommodated, the bottles accommodated within the resultant stowable container can easily and readily be picked up individually.

IV) When the stowable container is erected from the stowed or flattened condition, the longitudinally extending pocket is readily available for accommodating the printed matter. This printed matter can be accommodated in an upright position within the longitudinally extending pocket without overlaying the bottles accommodated in the container and, therefore, not only can the user readily ascertain the number and/or the type of the bottles no sooner than he or she opens the container, but also he or she can quickly pick up the individual bottles out of the container.

V) Rows of the bottles accommodated within the respective rows of the chambers within the container are separated from each other with the longitudinally extending pocket intervening therebetween and, therefore, even though the bottles accommodated in the container are small, the bottles in one of the rows can individually picked up out of the container easily without being interfered by the presence of the other row of the bottles.

VI) Where the buffer spaces are employed, each defined between each end wall and the outermost one of the transverse partition walls which is closest to such end wall allows some of the bottles which are positioned at respective corner regions within the stowable carton, to be easily and quickly picked up out of the container without being interfered by the end walls of the container.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENT

Figure 1:
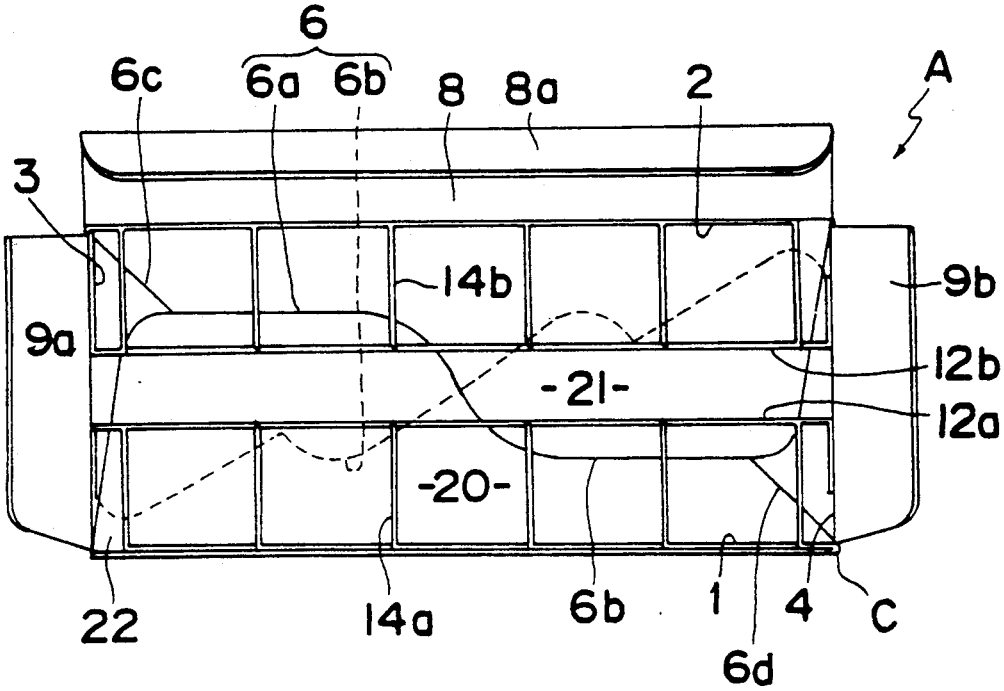
FIG. 1 is a top plan view of a stowable carton in an erected condition according to the present invention.
Figure 2:
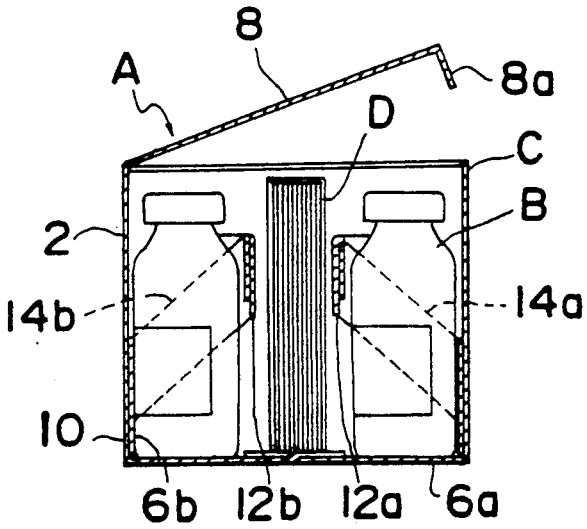
FIG. 2 is a transverse sectional view of the stowable carton shown in FIG. 1 with vials shown as accommodated therein.
Figure 3:
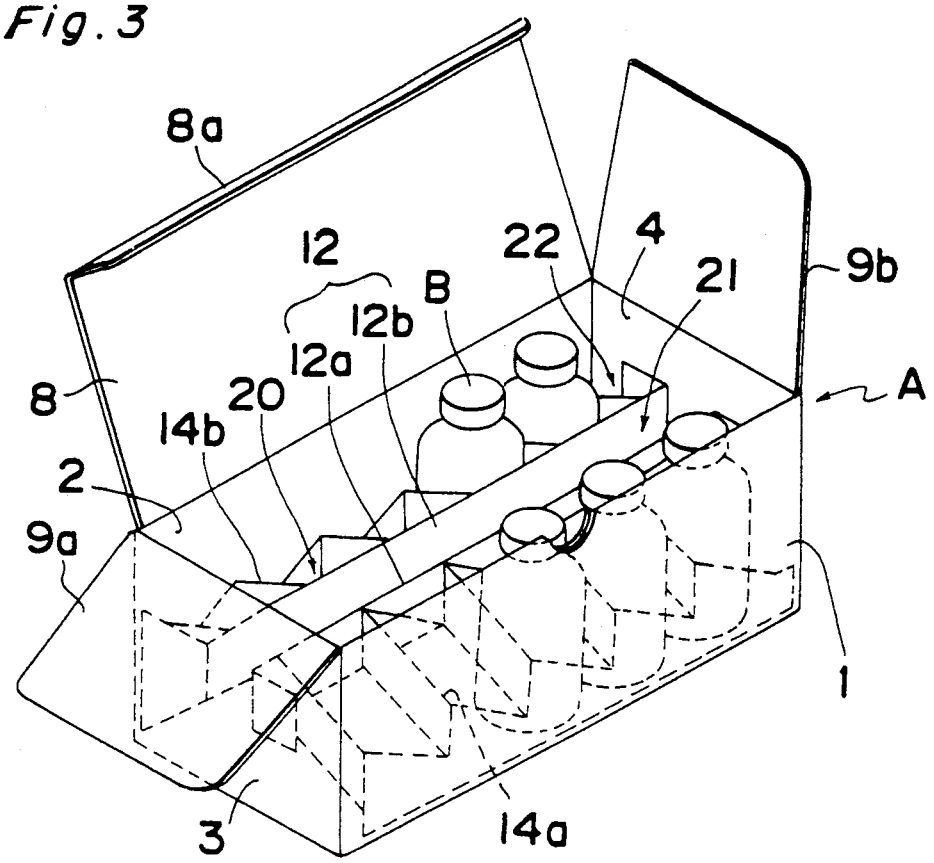
FIG. 3 is a perspective view, on a somewhat enlarged scale, showing the stowable carton in the erected condition with some of the vials accommodated therein.
Figure 4:
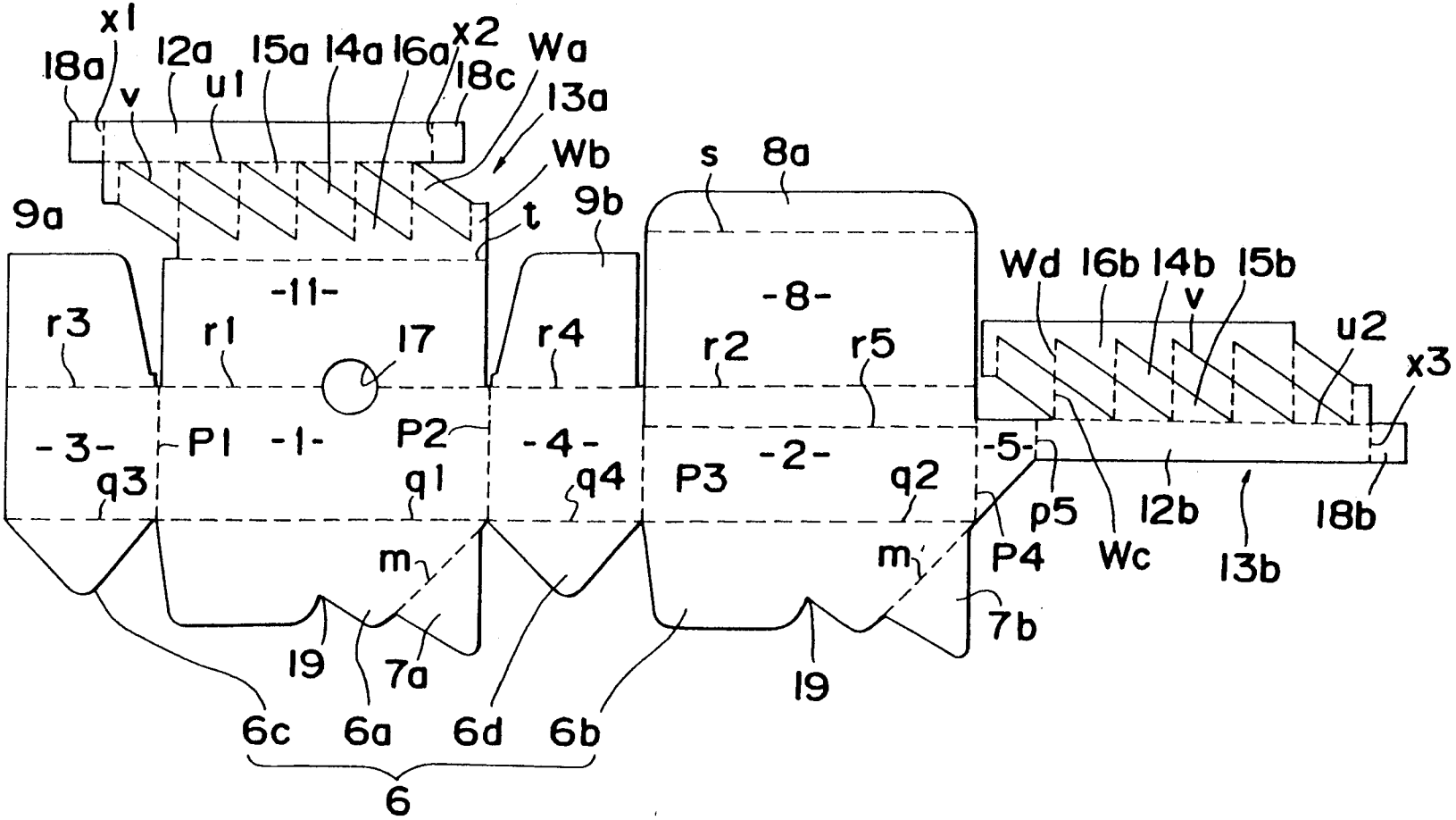
FIG. 4 is a plan view showing a blank sheet bearing the pattern of the stowable carton in a developed representation.
Figure 6:
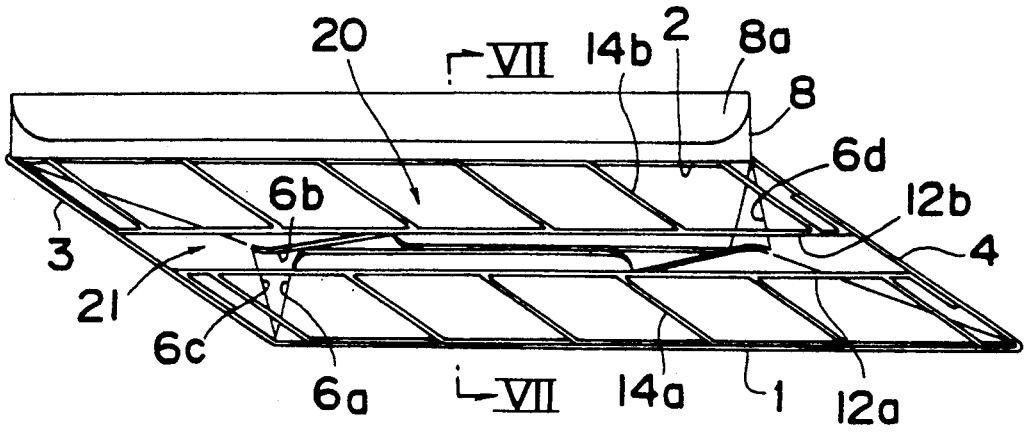
FIG. 6 is a top plan view showing the stowable carton being erected from the stowed condition.

Referring to the accompanying drawings and particularly to FIGS. 1 to 3, a stowable carton A according to the present invention comprises a generally rectangular box C of one-piece construction including front and rear side walls 1 and 2 that extend parallel to and in face-to-face relation to each other, left-hand and right-hand end walls 3 and 4 that extend parallel to and in face-to-face relation to each other, but perpendicular to the front and rear side walls 1 and 2, a top wall 8 hingedly connected to a top edge of the rear side wall 2 and having a tuck flap 8*a* hinged to a free side edge of the top wall, left-hand and right-hand top dust flaps 9*a* and 9*b* hingedly connected to respective top edges of the left-hand and right-hand end walls 3 and 4, and a bottom wall 6 (FIG. 4). The top wall 8 having the tuck flap 8*a* is adapted to selectively close and open a rectangular top opening of the box C while the bottom wall 6 closes a bottom opening of the box C. The left-hand and right-hand top dust flaps 9*a* and 9*b* are adapted to be folded inwardly of the top wall 8 to partially overlay the top opening of the box C when the top opening of the box C is closed.

The bottom wall 6 consists of front and rear bottom wall segments 6*a* and 6*b* hingedly connected with respective bottom edges of the front and rear side walls 1 and 2, and generally triangular left-hand and right-hand bottom flap segments 6*c* and 6*d* hingedly connected with respective bottom edges of the left-hand and right-hand end walls 3 and 4.

The rectangular box C also includes front and rear longitudinal partition walls 12*a* and 12*b* that extend parallel to each other and also to the front and rear side walls 1 and 2 and are spaced a distance from each other to define a pocket therebetween as will be described later, and a plurality of, for example, six, transverse partition walls 14*a* or 14*b* that are spaced an equal distance from each other while extending between each longitudinal partition wall 12*a* or 12*b* and the adjacent front or rear side wall 1 or 2 to define a respective row of bottle chambers 20 for accommodating medical vials generally identified by B.

As best shown in FIG. 2, while the bottle chambers 20 defined in front and rear rows along the front and rear side walls 1 and 2, respectively, are used to accommodate the vials B therein, the pocket 21 defined between the front and rear longitudinal partition walls 12*a* and 12*b* is used to accommodate therein printed matter D setting forth information such as, for example, efficacy, dosage or any other description associated with the contents of each or all of the medical vials B. The front and rear longitudinal partition walls 12*a* and 12*b* and the transverse partition walls 14*a* and 14*b* are effective to avoid any possible glass-to-glass contact among the medical vials B accommodated in the pockets 21.

Figure 5:
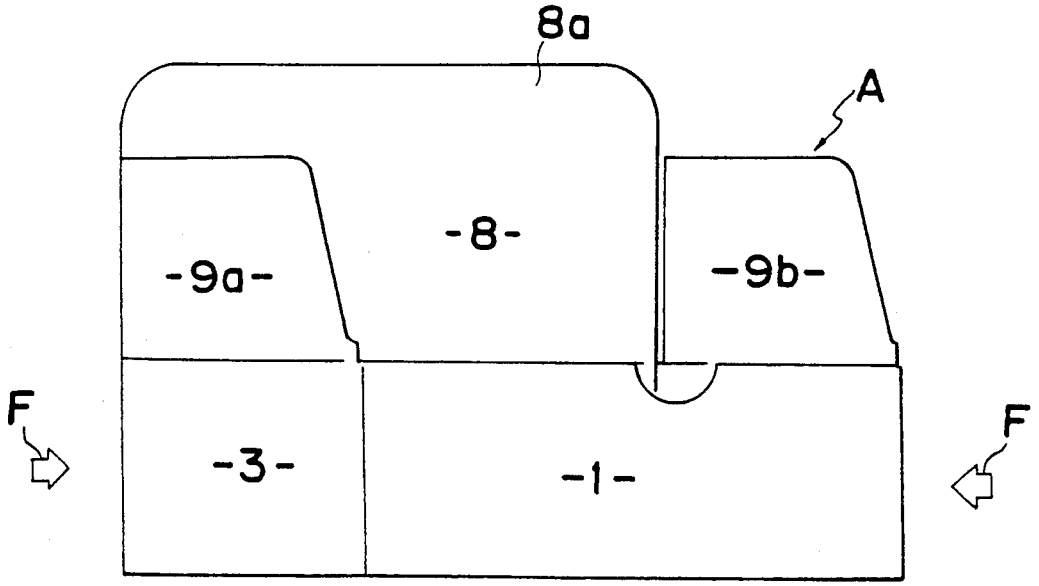
FIG. 5 is a side view showing the stowable carton in a stowed or folded condition.

By the reason which will become clear from the subsequent description, when the stowable carton A in an erected condition as shown in FIGS. 1 and 3 is applied an external pushing or shearing force necessary to move one of the front and rear side walls 1 and 2 relative to the other of the front and rear side walls 1 and 2 in a direction lengthwise of the erected stowable carton A while the top wall 8 and the top dust flaps 9*a* and 9*b* have been moved to open the carton A, the stowable carton A as a whole can be flattened to represent a generally flat multi-ply cardboard structure as shown in FIG. 5, having been accompanied by an inward buckling movement of the front and rear bottom wall segments 6*a* and 6*b* and the left-hand and right-hand bottom flap segments 6*c* and 6*d*. On the other hand, when the stowable carton A in a flattened or stowed condition as shown in FIG. 5 is applied an external pushing force inwardly from opposite directions as shown by the arrows F in FIG. 5, the stowable carton A can readily be erected to represent the generally box-like configuration as shown in FIG. 3, having been accompanied by an outward bucking movement of the bottom wall segments 6*a* and 6*b* and the bottom flap segments 6*c* and 6*b* to close an bottom opening of the stowable carton A.

The stowable carton A of the construction described above is made from a single blank of flexible sheet material such as, for example, cardboard, corrugated paper or plastic sheet that is patterned as best shown in FIG. 4, reference to which will now be made.

With reference to FIG. 4, the front side wall 1, rectangular in shape, has its opposite ends continued to the end walls 3 and 4 by means of respective vertical mountain-fold lines P1 and P2 parallel to each other, and also top and bottom edges continued to a backing wall 11, similar in shape and size to the front side wall 1, and the bottom wall segment 6*a* by means of respective horizontal mountain-fold lines r1 and q1 that extend parallel to each other and perpendicular to any one of the vertical mountain-fold lines P1 and P2.

The right-hand end wall 4 is in turn continued to the front side wall 2 through a vertical mountain-fold line P3 that extends parallel to any one of the mountain-fold lines P1 and P2 and is defined on one side thereof remote from the mountain-fold line P2. This right-hand end wall 4 has its top and bottom edges continued to the right-hand top dust flap 9*b* and the right-hand bottom flap segment 6*d* through respective horizontal mountain-fold lines r4 and q4 that extend parallel to each other and perpendicular to any one of the vertical mountain-fold lines P2 and P3.

The left-hand end wall 3, similar in shape to the right-hand end wall 4, is positioned on one side of the front side wall 1 remote from the right-hand end wall 4 and continued from the front side wall 1 by means of the mountain-fold line P1. This left-hand end wall 3 has its top and bottom edges continued to the left-hand top dust flap 9*a* and the left-hand bottom flap segment 6*c* by means of horizontal mountain-fold lines r3 and q3 that extend parallel to each other and perpendicular to the vertical mountain-fold line P1.

As shown in FIG. 4, the bottom dust flap segments 6*c* and 6*d* are triangle in shape, the base of which is defined by the horizontal mountain-fold lines q3 and q4 while two sides of the triangular shape of each bottom dust flap segment 6*c* and 6*d* are preferably inclined at 45° relative to the base so as to converge with each other at a point away from the associated end wall 3 and 4.

The front and rear bottom wall segments 6*a* and 6*b* forming respective parts of the bottom wall 6 are similar in shape to each other. Each of these bottom wall segments 6*a* and 6*b* has a free side edge spaced from the associated horizontal mountain-fold line q1 or q2. These bottom wall segments 6*a* and 6*b* have a generally V-shaped cutout 19 positioned generally intermediate of the length of the associated side wall 1 or 2 and extending inwardly from the respective free side edge so as to terminate at a point spaced outwardly from the associated horizontal mountain-fold line q1 or q2 a predetermined equal distance which is substantially half the spacing between the front and rear side walls 1 and 2 of the stowable carton A in the erected condition. The V-shaped cutout 19 defined in each of the front and rear bottom wall segments 6*a* and 6*b* is delimited by neighboring portions of the free side edge of the associated bottom wall segment 6*a* or 6*b* that extend slantwise towards the associated side wall 1 or 2 so as to converge at that point at an angle of about 90° relative to each other.

Each bottom wall segment 6a and 6b has a valley-fold line m defined therein so as to extend diagonally downwardly as viewed in FIG. 4 from a point where the horizontal mountain-fold line q1 or q2 intersects the vertical mountain-fold line P2 or P4 substantially at 45° relative to the horizontal mountain-fold line q1 or q2, leaving a generally triangular connecting tab 7a or 7b that form a part of the respective bottom wall segment 6a or 6b.

The backing wall 11 continued from the front side wall 1 is in turn continued to a front partition form 13a with a horizontal valley-fold line t defined between the backing wall 11 and the partition form 13a so as to extend parallel to the horizontal mountain-fold line r1. The front partition form 13a is utilized to eventually form the front partition wall 12a and the transverse partition walls 14a and, for this purpose, the front partition form 13a has an outermost rectangular region and an intermediate region bound between the valley-fold line t and a mountain-fold line u1 extending parallel to the valley-fold line t. The outermost rectangular region has two vertical fold lines x1 and x2 that divide the rectangular region into a left-hand connecting end 18a, a right-hand connecting end 18c and an intermediate wall flap which has a length substantially equal to the spacing between the end walls 3 and 4 of the erected stowable carton A and which, when folded outwardly as will be described later along the mountain-fold line u1, eventually forms the front partition wall 12a.

The intermediate region of the front partition form 13a that is delimited between the valley-fold line t and the mountain-fold line u1 has parallel cut lines V, equal in number to the number of the bottle chambers 20 in one row in the erected stowable carton A, defined therein so as to extend slantwise, preferably at 45°, relative to any one of the fold lines t and u1 thereby to leave six inclined parallel bands which eventually form the respective transverse partition walls 14a. These cut lines V extend slantwise from the mountain-fold line u1 to a point which may be set back inwardly from the valley-fold line t, thereby to leave a set-back region extending along the valley-fold line t.

Each of the inclined parallel bands which eventually form the respective transverse partition walls 14a has a valley-fold line Wa, extending perpendicular to and from the mountain-fold line u1 while defining a generally triangular connecting tab 15a bound by a respective portion of the mountain-fold line u1, the associated valley-fold line Wa and a portion of the neighboring cut line V, and a mountain-fold line Wb extending perpendicular to any one of the fold lines t and u1 in alignment with the valley-fold line Wa of the neighboring inclined band.

The front partition form 13a having the cut lines V defined therein is so patterned that, when the outermost rectangular region having the connecting ends 18a and 18c is displaced rightwards as viewed in FIG. 4 relative to the backing wall 11 until the fold lines x1 and x2 are brought in line with the mountain folds P1 and P2, respectively, the inclined bands are bent 90° outwardly along the associated mountain-fold lines Wb and inwardly along the associated valley-fold lines Wa, with the consequence that a portion of each inclined band delimited between the associated fold lines Wa and Wb forms the corresponding transverse partition wall 14a.

The rear side wall 2 is continued to a generally trapezoidal spacer flap 5 by means of a mountain-fold line P4 parallel to and positioned on one side of the rear side wall 2 remote from the mountain-fold line P3. This spacer flap 5 is in turn continued to a rear partition form 13b by means of a mountain-fold line P5 parallel to the mountain-fold line P4 and is delimited by the fold lines P4 and P5, an inclined edge aligned with the valley-fold line m in the rear bottom wall segment 6b and a horizontal edge parallel to, but positioned inwardly from the mountain-fold line r2.

The rear partition form 13b is utilized to eventually form the rear partition wall 12b and the transverse partition walls 14b and, for this purpose, the rear partition form 13b is similar in shape and structure to the front partition form 13a, but inverted in position relative to the front partition form 13a as can readily be understood from FIG. 4. More specifically, the rear partition form 13b has a rectangular region, continued from the spacer flap 5 by means of the mountain-fold line P5, and an intermediate region continued from the rectangular region by means of a mountain-fold line u2 that extends parallel to the valley-fold line t. The rectangular region has a vertical fold lines x3 that divides the rectangular region into a right-hand connecting end 18b remote from the spacer flap 5 and an intermediate wall flap which has a length substantially equal to the spacing between the end walls 3 and 4 of the erected stowable carton A and which, when folded outwardly as will be described later along the mountain-fold line u2, eventually forms the rear partition wall 12b.

The intermediate region of the rear partition form 13b has parallel cut lines V, equal in number to the number of the bottle chambers 20 in one row in the erected stowable carton A, defined therein so as to extend slantwise, preferably at 45°, relative to the fold line u2 thereby to leave six inclined parallel bands which eventually form the respective transverse partition walls 14b. These cut lines V extend slantwise from the mountain-fold line u2 to a point which may be set back inwardly from a horizontal free edge parallel to and opposed to the rectangular region, thereby to leave a set-back region extending along the horizontal free edge.

Each of the inclined parallel bands which eventually form the respective transverse partition walls 14b has a valley-fold line Wc, extending perpendicular to and from the mountain-fold line u2 while defining a generally triangular connecting tab 15b bound by a respective portion of the mountain-fold line u2, the associated valley-fold line Wc and a portion of the neighboring cut line V, and a mountain-fold line Wd extending perpendicular to the fold line u2 in alignment with the valley-fold line Wc of the neighboring inclined band.

The rear partition form 13b having the cut lines V defined therein is so patterned that, when the set-back region in the rear partition form 13b is displaced rightwards as viewed in FIG. 4 relative to the rectangular region having the connecting end 18b until the fold lines P5 and x3 are brought in line with the opposite ends of the set-back region, respectively, the inclined bands are bent 90° outwardly along the associated mountain-fold lines Wd and inwardly along the associated valley-fold lines Wc, with the consequence that a portion of each inclined band delimited between the associated fold lines Wc and Wd forms the corresponding transverse partition wall 14b.

Hereinafter, the manner in which the patterned blank of flexible sheet material such as shown in FIG. 4 is folded to form the stowable carton will be described. In describing the manner of folding the patterned blank of flexible sheet material shown in FIG. 4, it will be itemized for a better understanding thereof although the sequence of folding may not be always limited to that itemized.

1) Fold the outermost rectangular region of the front partition form 13*a* outwardly along the mountain-fold line u1 until it is brought into contact with a series of the triangular connecting tabs 15*a*, and then allow the outermost rectangular region to retain in contact with the series of the triangular connecting tabs 15*a*. If desired, the outermost rectangular region of the partition form 13*a* so folded may be bonded to the series of the triangular connecting tabs 15*a*.

2) Fold the backing wall 11 outwardly along the mountain-fold line r1 until it is brought into contact with the front side wall 1, and then allow the backing wall 11 to retain in contact with the front side wall 1. If desired, the backing wall 11 so folded may be bonded to the front side wall 1.

3) Fold the partition form 13*a* inwardly along the valley-fold line t to bring it in contact with the backing wall 11. If desired, a marginal portion of the partition form 13*a* adjacent the valley-fold line t and including a series of triangular regions 16*a* each delimited by the corresponding mountain-fold line Wb in the respective inclined band and a portion of the corresponding cut line V may be bonded to the backing wall 11.

4) Prior to or after any one of the steps (1) to (3) described above, displace the outermost rectangular region having the connecting ends 18*a* and 18*c* rightwards as viewed in FIG. 4 relative to the backing wall 11 until the fold lines x1 and x2 are brought in line with the mountain folds P1 and P2, respectively, allowing the inclined bands to be bent 90° outwardly along the associated mountain-fold lines Wb and inwardly along the associated valley-fold lines Wa so that that portion of each inclined band delimited between the associated fold lines Wa and Wb forms the corresponding front transverse partition wall 14*a*. By so doing, the front transverse partition walls 14*a* are separated from each other to substantially define the bottle chambers 20 in the front row.

5) Fold the rear partition form 13*b* outwardly along the mountain-fold line u2 until it is brought into contact with a series of the triangular connecting tabs 15*b*, and then allow the series of the triangular connecting tabs 15*b* in contact with the rectangular region of the rear partition form 13*b*. If desired, the series of the triangular connecting tabs 15*b* of rear partition form 13*b* so folded may be bonded to this rectangular region of the partition form 13*b*.

6) Prior to or after the step (5) described above, displace the set-back region in the rear partition form 13*b*, including a series of generally triangular regions 16*b* each delimited by the corresponding mountain-fold line Wd in the respective inclined band and a portion of the corresponding cut line V, rightwards as viewed in FIG. 4 relative to the rectangular region having the connecting end 18*b* until the fold lines P5 and x3 are brought in line with the opposite ends of the set-back region, respectively, allowing the inclined bands to be bent 90° outwardly along the associated mountain-fold lines Wd and inwardly along the associated valley-fold lines Wc so that that portion of each inclined band delimited between the associated fold lines Wc and Wd forms the corresponding rear transverse partition wall 14*b*. By so doing, the rear transverse partition walls 14*b* are separated from each other to substantially define the bottle chambers 20 in the rear row.

7) Fold the spacer flap 5 outwardly along the mountain-fold line P4, followed by folding of the rear partition form 13*b* outwardly along the mountain-fold line P5, thereby bringing the rear partition form 13*b* to the back of the rear side wall 2 as viewed in FIG. 4.

8) Then, make a firm crease along each of the mountain-fold lines P1, P2 and P3 by folding the rear side wall 2 outwardly along the fold line P3 so as to extend at right angles relative to the right-hand end wall 4, the right-hand end wall 4 outwardly along the fold line P2 so as to extend at right angles relative to the front side wall 1, and the front side wall 1 outwardly along the fold line P1 so as to extend at right angles relative to the left-hand end wall 3. By so doing, the front and rear side walls 1 and 2 and the end walls 3 and 4 forms a generally rectangular cross-sectional shape.

9) Subsequent to the step (8), bond the spacer flap 5 to a portion of the left-hand end wall 3 adjacent a top left corner thereof as viewed in FIG. 4 to set the front and rear side walls 1 and 2 and the end walls 3 and 4 to represent the rectangular cross-sectional shape substantially permanently.

10) After or before the step (9) above, bond the connecting ends 18*a* and 18*c* in the front partition form 13*a* to the end walls 3 and 4, respectively, and bond the connecting end 18*b* in the rear partition form 13*b* to the left-hand end wall 3, thereby allowing the front and rear longitudinal partition walls 12*a* and 12*b* to extend substantially parallel between the end walls 3 and 4 while the front and rear transverse partition walls 14*a* and 14*b* extend transversely between the front longitudinal partition wall 12*a* and the backing wall 11, hence, the front side wall 1, and between the rear longitudinal partition wall 12*b* and the rear side wall 2, respectively.

11) Fold the bottom wall segments 6*a* and 6*b* and the flap segments 6*c* and 6*d* outwardly along the mountain-fold lines q1, q2, q3 and q4, respectively, to bring them inside the rectangular cross-sectional contour assumed by the side walls 1 and 2 and the end walls 3 and 4 while lying substantially perpendicular to the side walls 1 and 2 and the end walls 3 and 4. Then, bond the bottom flap segments 6*c* and 6*d* to the connecting tabs 7*b* and 7*a*, respectively.

Although not essential, but in order to facilitate an easy access of the user's finger to the tuck flap 8*a* at the time the erected stowable carton containing the vials B is desired to be opened, a round hole 17 shown in FIG. 4 may be formed in part in the front side wall 1 and in part in the backing wall 11 while straddling over an intermediate portion of the mountain-fold line r1. This hole 17 when the stowable carton A is in the erected condition as shown in FIG. 3, forms a generally semicircular recess while allowing a portion of the tuck flap 8*a* to be exposed to the outside.

Similarly although not essential, but in order to facilitate an easy access to the row of the bottles accommodated within the rear row of the bottle chambers 20 adjacent the rear side wall 2 when the top wall 8 is opened while the stowable container is in the erected condition, the rear side wall 2 may have a bending line r5 extending parallel to and spaced a distance inwardly from the fold line r2 to facilitate a backward bending of a portion of the rear side wall 2, adjacent the top wall 8 and delimited between the lines r2 and r5, as the top wall 8 is opened, permitting substantially top portions of the bottles within the rear row of the bottle chambers 20 to be exposed wide open to the outside. For this purpose, respective portions of the fold lines P3 and P4 which are delimited between the lines r2 and r5 are cut.

In folding particularly the bottom wall segments 6a and 6b outwardly along the mountain-fold lines q1 and q2 to bring them inside the rectangular cross-sectional contour assumed by the walls 1 to 4, care must be taken that left-hand and right-hand halves of the front bottom wall segment 6a come above and beneath right-hand and left-hand halves of the rear bottom wall segment 6b, respectively, thereby to allow the front and rear bottom wall segments 6a to 6b to substantially intersect with each other while partially overlapping each other as seen from FIG. 1.

By performing the folding steps (1) to (11) described above, the stowable carton A according to the present invention is completed.

Figure 7:
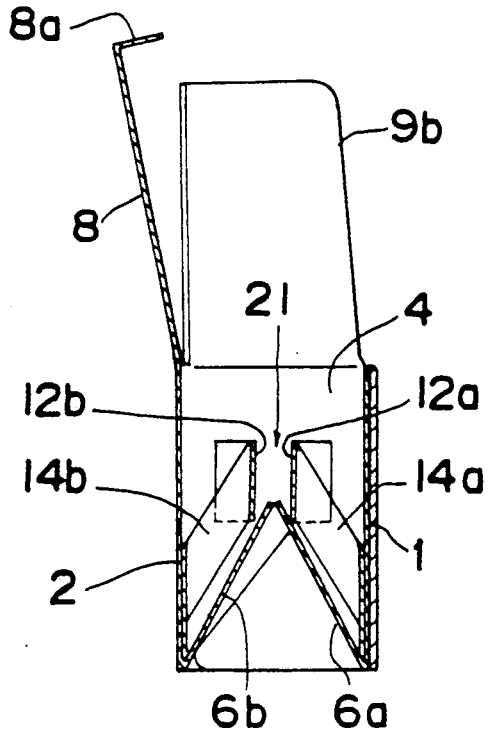
FIG. 7 is a cross-sectional view taken along the line VII—VII in FIG. 6.

To fold the stowable carton A in the erected condition up into the flattened condition as shown in FIG. 5, all that are necessary is to apply an external pushing force from opposite directions to allow the diagonally opposite corners of the stowable carton containing the mountain-fold lines P1 and P3 to come close together, but to allow the diagonally opposite corners containing the mountain-fold lines P2 and P4 to separate away from each other. At this time, the bottom wall segments 6a and 6b and the bottom flap segments 6c and 6d connected with the connecting tabs 7b and 7a of the respective bottom wall segments 6a and 6a are buckled inwardly of the rectangular box C, accompanied by an inward bending of the connecting tabs 7a and 7b about the valley-fold lines m and, also, an inward bending of the segments 6a, 6b, 6c and 6d about the fold lines q1, q2, q3 and q4. At the same time, the free side edge portions of the bottom wall segments 6a and 6b then being buckled about the fold lines q1 and q2 protrude in between the front and rear longitudinal partition walls 12a and 12b as shown in FIG. 7 while the front and rear longitudinal partition walls 12a and 12b are displaced sideways in opposite directions so as to be brought into contact with the front and rear side walls 1 and 2.

To erect the stowable carton in the stowed condition into the erected condition as shown in FIG. 1, application of an external pushing force to the diagonally opposite corners containing the respective fold lines P2 and P3 to draw those corners close together as shown by the arrow F in FIG. 5 is sufficient. At this time, the bottom segments 6a, 6b, 6c and 6d are buckled outwardly of the rectangular box C, accompanied by an outward bending of the connecting tabs 7a and 7b about the valley-fold lines m and, also, an outward bending of the segments 6a, 6b, 6c and 6d about the fold lines q1, q2, q3 and q4. At the same time, the free side edge portions of the bottom wall segments 6a and 6b move downwardly within between the front and rear longitudinal partition walls 12a and 12b to separate away therefrom while the front and rear longitudinal partition walls 12a and 12b are displaced sideways in opposite directions so as to separate away from the front and rear side walls 1 and 2.

With the stowable carton in the erected condition, the vials B are individually inserted into the bottle chambers 20 and, thereafter, the top dust flaps 9a and 9b, the top wall 8 and the tuck flap 8a are successively folded inwardly along the fold lines r3, r4, r2 and S, respectively, so that the tuck flap 8a is inserted in between the top dust flaps 9a and 9b to close the top opening of the stowable carton A.

In designing the patterned blank of flexible sheet material as shown in FIG. 5, it is preferred that care be paid so that the longitudinal partition walls 12a and 12b occupy respective positions spaced an equal distance above the bottom of the stowable carton in the erected condition and set back inwardly from the level of the top opening of the stowable carton so as to allow respective capped tops of the vials B, then received within the bottle chambers 20, to protrude outwardly from the longitudinal partition walls 12a and 12b as best shown in FIG. 2. This is particularly advantageous in that, with no need to use a vial holder or any other tool, the user can easily pick up the individual vials B within the stowable carton to take them out of the carton. This advantage is more enhanced in view of the presence of the pocket 21 between the longitudinal partition walls 12a and 12b because the printed matter D need not be laid down so as to overlay the vials B such as practiced in the prior art carton and is accommodated within the pocket 21 in an upright fashion without interfering an access to the individual vials B.

In the stowable carton according to the present invention, the bottle chambers 20 in each front or rear row are independent from each other, having been bound by the neighboring partition walls 14a or 14b, the longitudinal partition wall 12a or 12b and the front or rear side wall 1 or 2 and, therefore, the individual vials B to be accommodated within the stowable carton need not be wrapped with any wrapping material which has hitherto been required to avoid a glass-to-glass contact.

As best shown in FIG. 1, the presence of buffer spaces 22 each defined between each end wall 3 and 4 and the outermost one of the front or rear transverse partition walls 14a and 14b which is closest to such end wall 3 or 4 allows some of the vials B, which are positioned at respective corner regions within the stowable carton A, to be kept apart from the adjacent end walls 3 and 4 so that the user can easily pick up those vials B to take them out of the carton A.

Although the present invention has been described in connection with the preferred embodiments thereof with reference to the accompanying drawings, it is to be noted that various changes and modifications are apparent to those skilled in the art. For example, although the front and rear partition forms 13a and 13b have been described and shown as respective integral parts of the patterned blank of sheet material, they may be separate from the patterned blank of sheet material and may therefore be set in position with the use of any suitable bonding agent.

The various fold lines in the patterned blank of flexible sheet shown in FIG. 4 may be defined in the form of a line or dotted indentation, a roulette or perforated line or any other crease. However, to facilitate a quick and smooth bucking of the bottom wall segments 6a and 6b accompanied by a corresponding bucking of the bottom flap segments 6c and 6d when the stowable carton is being stowed, the valley-fold lines m defined in the bottom wall segments 6a and 6b are preferred to be a roulette line of fold.

Accordingly, such changes and modifications are to be understood as included within the scope of the present invention as defined by the appended claims, unless they depart therefrom.

What is claimed is:

1. A stowable container of generally rectangular box-like configuration which comprises:

first and second side walls extending parallel to and in face-to-face relation to each other;

first and second end walls that extend parallel to and in face-to-face relation to each other, but perpendicular to the first and second side walls;

a top wall member hingedly connected to a top edge of the second side wall and adapted to selectively close and open a rectangular top opening of the container when the container is in an erected condition;

a bottom wall adapted to closes a bottom opening of the container and including a pair of bottle wall segments hingedly connected to respective bottom edges of the first and second side walls, and a pair of bottom flap segments connected with respective portions of the bottom wall segments and hingedly connected to respective bottom edges of the first and second end walls, said bottom wall segments and said bottom flap segments defining said bottom wall when overlapped with each other in an offset relationship with each other;

first and second longitudinal partition walls extending parallel to each other and also to the first and second side walls while being spaced a distance from each other to define a longitudinally extending pocket therebetween; and a plurality of transverse partition walls spaced an equal distance from each other while extending between each longitudinal partition wall and the adjacent side wall to define a respective row of chambers for accommodating articles to be contained within the stowable container;

said bottom wall segments and said bottom flap segments being bucked inwardly of the container and into the longitudinally extending pocket when the stowable container is folded thereby to allow the stowable container to be substantially flattened in a stowed condition.

2. The stowable container as claimed in claim 1, wherein a buffer space is defined within the container between each of the first and second end wall and one of outermost opposite transverse partition walls in each row.

3. The stowable container as claimed in claim 1, wherein the second side wall has a fold line defined therein at a location spaced a distance inwardly from the top edge thereof to facilitate a backward bending of a portion of the second side wall delimited by the top edge and said fold line when the top wall member is opened.

4. The stowable container as claimed in claim 1, wherein said first side wall includes a side wall segment and a backing continued from said side wall segment and folded inwardly along a top fold line to overlap said side wall segment when the stowable container is in an erected condition, respective portions of said side wall segment and said backing adjacent the top fold line and generally intermediate of a length of the top fold line being formed with a round hole which, when the stowable container is in an erected condition forms a generally semi-circular recess to facilitate an access to the top wall member.

5. The stowable container as claimed in claim 1, wherein each of said bottom wall segments has a portion which overlaps the respective bottom flap segment when the stowable container is in an erected condition, said portion of the respective bottom wall segment and the remainder thereof being defined by a roulette line.

* * * * *